US011299843B2

(12) United States Patent
Kanagawa et al.

(10) Patent No.: US 11,299,843 B2
(45) Date of Patent: Apr. 12, 2022

(54) WASHING MACHINE

(71) Applicant: Samsung Electronics Co., Ltd, Suwon-si (KR)

(72) Inventors: Tomoyuki Kanagawa, Kanagawa (JP); Hiroyuki Miyake, Kanagawa (JP); Shin Kagami, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/591,563

(22) Filed: Oct. 2, 2019

(65) Prior Publication Data

US 2020/0102686 A1 Apr. 2, 2020

(30) Foreign Application Priority Data

Oct. 2, 2018 (JP) ..... JP2018-187326
Jul. 25, 2019 (KR) ..... 10-2019-0090121

(51) Int. Cl.
*D06F 23/04* (2006.01)
*D06F 37/30* (2020.01)
*D06F 34/18* (2020.01)

(52) U.S. Cl.
CPC ..... *D06F 37/304* (2013.01); *D06F 23/04* (2013.01); *D06F 34/18* (2020.02)

(58) Field of Classification Search
None
See application file for complete search history.

(56) References Cited

U.S. PATENT DOCUMENTS 6,038,724 A * 3/2000 Chbat ..... D06F 34/18 8/159
9,200,401 B2 12/2015 Chung et al.
9,745,685 B2 8/2017 Jang et al.
9,930,533 B2 3/2018 Jin et al.
10,657,969 B2 5/2020 Shi et al.
2009/0199598 A1* 8/2009 Kanazawa ..... D06F 34/18 700/275

(Continued)

FOREIGN PATENT DOCUMENTS

CN 101047508 A 10/2007
CN 104639517 A 5/2015

(Continued)

OTHER PUBLICATIONS

Espacenet translation JP 2011-110132 , Drum type washing machine, 2011 (Year: 2011).*

(Continued)

*Primary Examiner* — Cristi J Tate-Sims

(57) ABSTRACT

In any type of washing machine, an amount of laundry introduced into the washing machine may be measured in a short time with high accuracy. A washing machine includes a rotational spin tub into which laundry is introduced; a driving unit including a motor for rotating the spin tub; and at least one processor configured to control the driving unit to rotate the spin tub at first rotational speed, control the driving unit to rotate the spin tub at second rotational speed, and identify weight of the laundry based on acceleration at the time of changing of rotational speed of the spin tub from the first rotational speed to the second rotational speed and the second rotational speed.

12 Claims, 11 Drawing Sheets

(56) References Cited

U.S. PATENT DOCUMENTS

| | | | | |
|---|---|---|---|---|
| 2009/0205377 | A1* | 8/2009 | Suel, II | G01G 19/56 68/12.04 |
| 2013/0160221 | A1* | 6/2013 | Ashrafzadeh | D06F 33/48 68/12.04 |
| 2014/0101865 | A1 | 4/2014 | Jang et al. | |
| 2016/0369446 | A1 | 12/2016 | Leonard et al. | |
| 2018/0286395 | A1 | 10/2018 | Li et al. | |
| 2019/0055689 | A1* | 2/2019 | Pesavento | D06F 33/32 |

FOREIGN PATENT DOCUMENTS

| | | | |
|---|---|---|---|
| CN | 105321520 | A | 2/2016 |
| CN | 108259280 | A | 7/2018 |
| CN | 108288470 | A | 7/2018 |
| CN | 108492830 | A | 9/2018 |
| CN | 108615537 | A | 10/2018 |
| DE | 19857903 | A1 | 6/1999 |
| EP | 1605087 | A1 | 12/2005 |
| EP | 2090870 | A2 | 8/2009 |
| JP | 10-314484 | A | 12/1998 |
| JP | 2011-110132 | A | 6/2011 |
| KR | 10-2014-0043543 | A | 4/2014 |
| KR | 10-2014-0045714 | A | 4/2014 |

OTHER PUBLICATIONS

International Search Report dated Jan. 23, 2020 in connection with International Patent Application No. PCT. KR2019/012849, 3 pages.

China National Intellectual Property Administration, "The First Office Action", dated Aug. 11, 2021, in connection with Chinese Patent Application No. 201811620418.7, 16 pages.

Supplementary European Search Report dated Aug. 2, 2021, in connection with European Patent Application No. 19868710.5, 6 pages.

* cited by examiner

WASHING MACHINE

CROSS-REFERENCE TO RELATED APPLICATION

This application is based on and claims priority under 35 U. S.C. § 119 to Japanese Patent Application No. 2018-187326 filed on Oct. 2, 2018 and Korean Patent Application No. 10-2019-0090121 filed on Jul. 25, 2019, the disclosures of which are herein incorporated by reference in their entirety.

BACKGROUND

1. Field

The disclosure relates to a washing machine, and more particularly, to a washing machine having a technology to measure a weight of laundry introduced into the washing machine.

2. Description of Related Art

Most of today's washing machines have automated courses of washing, rinsing, spin-drying, and the like. In each of the washing and rinsing courses, water supply is automatically performed, in which case an amount of the laundry (clothes) introduced into the washing machine is automatically measured to determine an amount of water to be supplied.

For example, referring to patent document 1, the washing tub is rotated by motor driving, after the washing tub is loaded with the clothes. As the rotation of the washing tub is accelerated, acceleration time until the rotation speed of the washing tub reaches a particular rotation speed is measured.

Subsequently, the rotation of the washing tub is decelerated, and deceleration time until the rotation of the washing tub reaches a certain rotation speed is measured. The acceleration and deceleration of rotation are calculated, and finally, the moment of inertia of the washing tub loaded with clothes is calculated. An amount of the clothes is specified from the mutual relationship between the moment of inertia and the weight of the clothes.

Referring to patent document 2, a drum is rotated by motor driving after clothes are introduced into the drum, and then the motor conduction is terminated. The drum is then rotated by inertia, gradually slowing down due to frictional torque of the motor, and finally stopped. Because a time required for the drum to be stopped is proportional to the weight of the clothes, the proportional relationship is used to measure the amount of clothes.

PRIOR ART LITERATURE

Patent Document 1: JP Patent Publication No. 2003-210888

Patent Document 2: JP Patent Publication No. 2013-43030

SUMMARY

In patent documents 1 and 2, changes in rotation state while the spin tub (or washing tub, drum) loaded with clothes is being decelerated is used to measure the weight of laundry.

In order to use the change in rotation state during deceleration, the spin tub needs to be rotate up to sufficiently high rotations per minute (rpm). Hence, it takes a while to measure the weight of laundry. To increase accuracy in measurement of the weight of the laundry, the measurement needs to be performed several times, in which case, however, it would take more time.

Furthermore, in the methods as disclosed in the patent documents 1 and 2, rotations of the motor and the spin tub need to coincide. In other words, a so-called 'direct driving', which means that the rotational shaft of the motor directly rotates the spin tub, is premised. In an indirect driving method in which a motor drives the spin tub through a belt, there is a difference in rotation between the motor and the spin tub, making it difficult to obtain adequate measurement accuracy.

Furthermore, of washing machines equipped with a clutch between the spin tub and the motor, there is a type of washing machine that has a spin tub automatically separated from the motor during deceleration of the spin tub. For this type of washing machine, it is not possible to use the method as disclosed in the patent documents 1 and 2.

The disclosure provides a washing machine having a technology to accurately measure the weight of laundry introduced into the washing machine for a short time.

In accordance with an aspect of the disclosure, a washing machine includes a rotational spin tub into which laundry is introduced; a driving unit including a motor for rotating the spin tub; and at least one processor configured to control the driving unit to rotate the spin tub at first rotational speed, control the driving unit to rotate the spin tub at second rotational speed, and identify weight of the laundry based on acceleration at the time of changing of rotational speed of the spin tub from the first rotational speed to the second rotational speed and the second rotational speed.

The washing machine rotates the spin tub through torque control that applies certain torque to the spin tub loaded with laundry. The spin tub engaged with the motor output is then accelerated, and then rotated at a constant rotational speed corresponding to the torque. The at least one processor may rotate the spin tub at the first rotational speed by applying first torque, and then control the driving unit to rotate the spin tub at the second rotational speed by applying second torque greater than the first torque.

The washing machine may measure acceleration and rotational speed of the spin tub in a stable state, and measure the weight of the laundry more accurately.

Because the acceleration and rotational speed of the spin tub are affected by a mechanical loss, it is not possible to obtain a highly accurate measurement of the weight of the laundry when the measurement is performed based on the acceleration and rotational speed on which the mechanical loss is not reflected. In this regard, the acceleration and the rotational speed, which are affected by the mechanical loss, have a predefined linear relationship associated with the size of a load applied to the spin tub.

The washing machine may measure the weight of the laundry by using the linear relationship and based on the acceleration and rotational speed during constant speed rotation of the spin tub. Hence, the washing machine may measure the weight of the laundry with high accuracy without using the change in rotational state during deceleration. As a result, various types of washing machines may measure the weight of laundry with high accuracy in a short time, thereby securing high universality and secure more effective water saving.

The washing machine may further include at least one memory, and the at least one memory may store base information including linear relationship information between the acceleration and the second rotational speed associated with a size of a load applied to the spin tub, and the at least one processor may identify the weight of the laundry based on the acceleration, the second rotational speed, and the base information.

The linear relationship information required for measurement of the weight of the laundry is stored in advance as data, the weight of the laundry may be measured quickly and clearly with high accuracy.

When the motor is an asynchronous motor, the at least one processor may control the driving unit to drive the motor with a first voltage and a first frequency so that the spin tub is rotated at the first rotational speed, and control the driving unit to drive the motor with a second voltage and a second frequency so that the spin tub is rotated at the second rotational speed.

Accordingly, the disclosure may be easily applied to the existing washing machines.

In this case, the driving unit may further include an inverter for controlling driving of the motor, and the at least one processor may obtain the acceleration and the second rotational speed based on a current output from the inverter to the motor.

Accordingly, the acceleration and the rotational speed may be obtained without need for an extra device for measuring rotational speed or the like, thereby saving the cost.

When the motor is a synchronous motor, the at least one processor may control the driving unit to drive the motor with a first current so that the spin tub is rotated at the first rotational speed, and control the driving unit to drive the motor with a second current so that the spin tub is rotated at the second rotational speed.

The washing machine may further include at least one memory, and the memory may store temperature correction information including linear relationship information between each of the acceleration and the second rotational speed, and temperature of the motor, and the at least one processor may correct the acceleration and the second rotational speed based on the temperature correction information.

Because the acceleration and the rotational speed are affected by motor temperature, accuracy in measuring the weight of the laundry may be reduced. Taking this into account, the washing machine according to an embodiment of the disclosure corrects the acceleration and rotational speed based on temperature correction information corresponding to the motor temperature when measuring the weight of the laundry. Accordingly, influence of the motor temperature may be reduced, and the weight of the laundry may be measured with high accuracy.

In this case, the at least one processor may identify temperature of the motor based on resistance of a coil of the motor and resistance information stored in the memory.

The at least one processor may control the driving unit to apply a predefined direct current (DC) voltage to the coil, and measure resistance of the coil.

Accordingly, without need for an extra temperature sensor, the temperature of the motor may be obtained, thereby saving the cost.

Furthermore, the at least one processor may measure the weight of the laundry several times, and based on the plurality of measurement results, identify the weight of the laundry. In this case, the at least one processor may control the driving unit to drive the spin tub to be rotated at a different rotational speed for each time.

Accordingly, the amount of laundry may be measured with higher accuracy and water is saved more effectively.

Furthermore, the driving unit may further include a clutch for switching between a connected state in which the motor and the spin tub are connected and a disconnected state in which the motor and the spin tub are disconnected, and the clutch may switch the spin tub from the connected state to the disconnected state when the spin tub is decelerated.

As for a washing machine including the clutch, due to the structure, the existing method for measuring the weight of laundry may not be applied. With the technology as described above, a washing machine including a clutch may measure the weight of laundry in a short time with high accuracy.

Furthermore, the driving unit may further include a variable belt interposed between the motor and the spin tub for transmitting driving power of the motor to the spin tub.

As for a washing machine including the variable belt, the existing method for measuring the weight of laundry may be applied but the measurement accuracy might be reduced due to the structure. However, using the technology as described above, a washing machine including the variable belt may measure the weight of laundry in a short time with high accuracy.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 9B, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments of the disclosure will now be described in detail with reference to accompanying drawings. The embodiments are merely examples, without being limited thereto.

Figure 1:
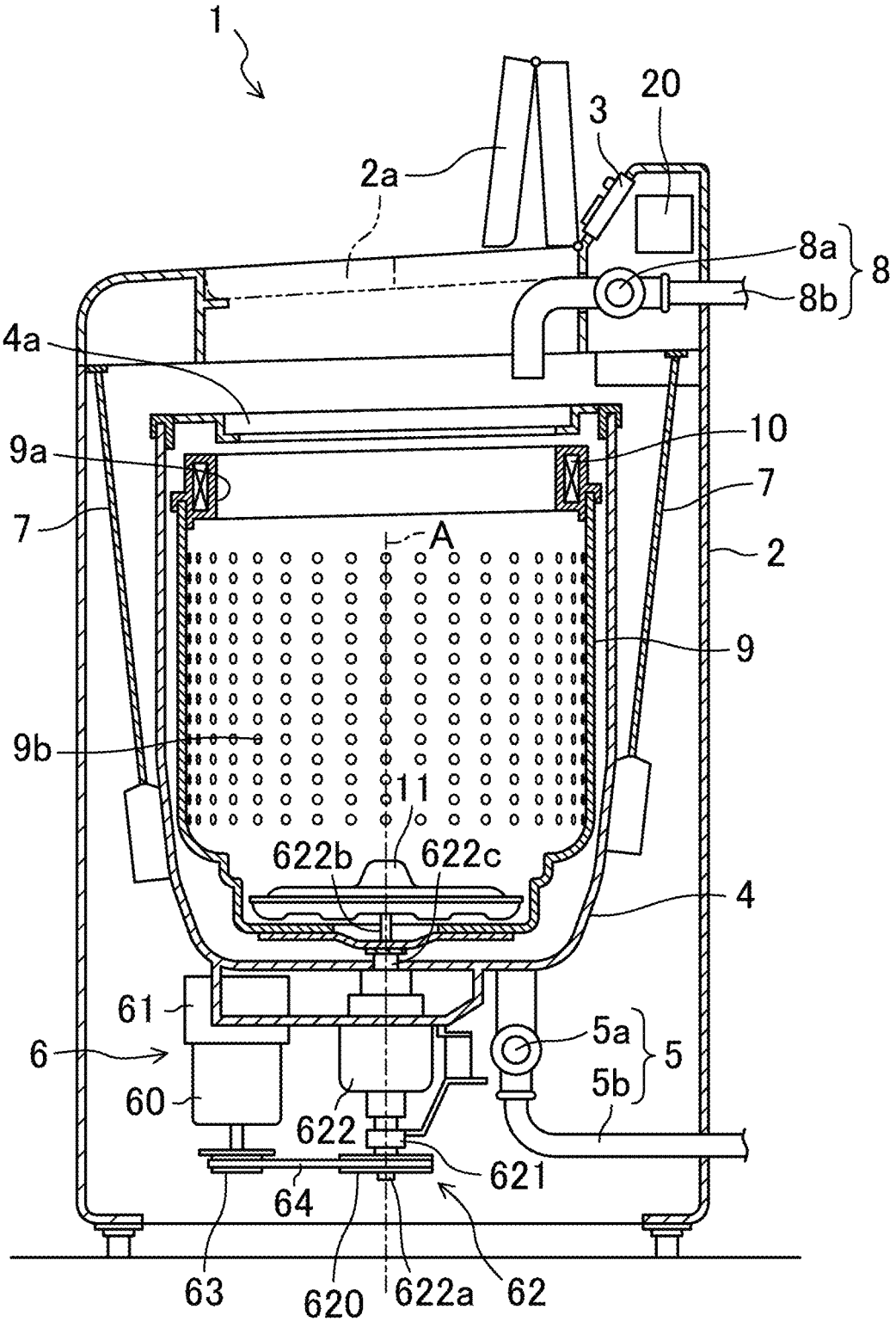
FIG. 1 illustrates a schematic cross-sectional view of a primary structure of a washing machine, according to an embodiment of the disclosure.

FIG. 1 illustrates a schematic cross-sectional view of a primary structure of a washing machine, according to an embodiment of the disclosure. Referring to FIG. 1, a washing machine 1 is a full automatic top load washing machine. A series of courses, such as washing, rinsing spin-drying, etc., are automatically performed under an instruction of the user. The washing machine 1 may include a main body 2 shaped like a vertically long box, and an operator 3 with switches or buttons arranged thereon provided on the top and rear of the main body 2. The instruction of the user is received through the operator 3.

An opening covered by a door 2*a* that may be opened or closed are formed on the main body 2 in front of the operator 3. Laundry such as clothing is introduced into the main body 2 through the opening. A fixed tub 4 that may store water is installed in the main body 2. The fixed tub 4 is a cylindrical container with the bottom. An inlet 4*a* is formed on the top of the fixed tub 4 to face the opening. A drain system 5 and a driving system 6 are provided under the fixed tub 4. The driving system 6 may be called a driving unit 6.

The fixed tub 4 may fluctuate because the fixed tub 4 is suspended from the main body 2 by the wire 7. A water supply system 8 connected to an external water source is provided in an upper portion of the main body 2. The water supply system 8 includes a water supply valve 8*a* and a water supply pipe 8*b*. When the water supply valve 8*a* is opened, water is automatically supplied into the fixed tub 4.

A spin tub 9 is accommodated in the fixed tub 4. The spin tub 9 may be rotated around a vertical axis A. The spin tub 9 is shaped like a cylindrical container with the bottom, and an entrance 9*a* is formed on the top of the spin tub 9. The spin tub 9 is accommodated in the fixed tub 4 so that the entrance 9*a* of the spin tub 9 faces the inlet 4*a*. Accordingly, the laundry is introduced into the spin tub 9 through the inlet 4*a* and the entrance 9*a*.

A plurality of through holes 9*b* are formed on the side of the spin tub 9. A ring-shaped balancer 10 is installed on the top of the spin tub 9 to keep the spin tub 9 balanced during high speed rotation. A disc-shaped pulsator 11 is installed on the bottom of the spin tub 9.

The drain system 5 includes a drain valve 5*a*, a drain pipe 5*b*, etc., and the drain system 5 is connected to a drainage hole formed at the bottom of the fixed tub 4. When the drain valve 5*a* is opened for draining, the water contained in the fixed tub 4 is released out of the washing machine 1 by natural drainage due to gravity.

Figure 2:
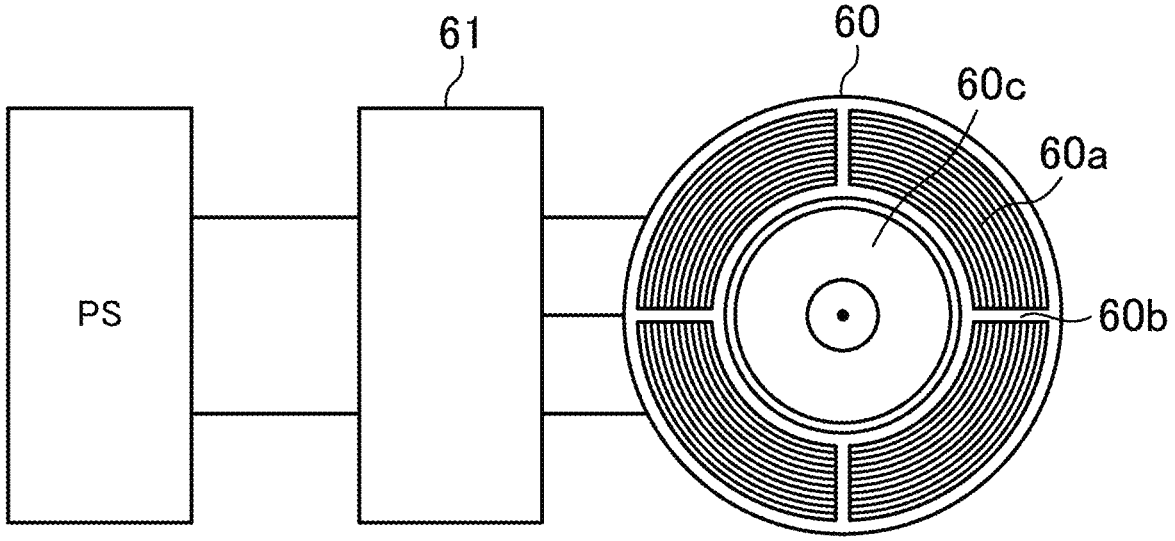
FIG. 2 illustrates a schematic diagram of a structure of a driving unit.

The driving system 6 includes a motor 60, an inverter 61, a power transmitter 62, etc. The driving system 6 may be called a driving unit 6. The driving system 6 rotates the pulsator 11 and the spin tub 9 by using the motor 60 as a power source. As shown in FIG. 2, the motor 60 is connected to an external power source PS through the inverter 61. In general, the external PS is a commercial alternate current (AC) power source, and the inverter 61 may include a converter in an embodiment of the disclosure. Accordingly, the inverter 61 may be connected to a direct current (DC) PS or AC PS and may perform voltage conversion.

In the inverter 61, there is a common electric circuit including a plurality of switching devices such as insulated gate bipolar transistors (IGBTs), a plurality of free wheeling diodes connected in anti-parallel with the switching devices, three arms on which the switching devices and free wheeling diodes are arranged, etc. The inverter 61 converts a DC voltage converted by turning on and off the switching device of each arm to three AC voltages of different phases U, V, W, and outputs the AC voltages.

In an embodiment, the motor 60 is an inductive motor (asynchronous motor). The motor 60 includes a cylindrical stator 60*b* equipped with a plurality of coils 60*a* and a cargo-shaped rotor 60*c* rotationally arranged inside the stator 60*b*. FIG. 2 illustrates a simplified version of the motor 60.

When different phases of AC currents flow in the coil 60*a*, different phase magnetic fields are produced around the stator 60*b*. Due to an inductive current resulting from the magnetic field, the rotor 60*c* is rotated at a speed slower than a synchronous speed. That is, the motor 60 produces 'slip' while being rotated.

In an embodiment, the motor 60 is a three-phase motor. In this case, three-phase AC currents output from the inverter 61 are input to the motor 60. The motor 60 is driven by the three-phase AC currents. As shown in FIG. 1, a main pulley 63 is coupled to an output shaft of the motor 60.

A power transmission system 62 includes a sub-pulley 620, a clutch 621, a conversion mechanism part 622, etc. The power transmission system 62 is installed under the fixed tub 4 so that the center of the power transmission system 62 is aligned with the vertical axis A. The conversion mechanism part 622 includes an input shaft 622*a* protruding downward, a first vertical power shaft 622*b* penetrating the bottom of each of the fixed tub 4 and the spin tub 9 and having a front end fixed to the pulsator 11, and a second vertical power axis 622*c* fixed to the bottom of the spin tub 9.

The sub-pulley 620 is installed at the input shaft 622*a*. The sub-pulley 620 and the main pulley 63 are coupled by a variable belt 64. Accordingly, the driving power of the motor 60 is transmitted to the power transmission system 62 through the variable belt 64.

The conversion mechanism part 622 may switch between a "washing/rinsing mode" in which to decouple the input shaft 622*a* from the second vertical power shaft 622*c* and couple the input shaft 622*a* to the first vertical power shaft 622*b*, and a "spin-dry mode" in which to decouple the input shaft 622*a* from the first vertical power shaft 622*b* and couple the input shaft 622*a* to the second vertical power shaft 622*c*. That is, when the motor 60 is rotated in the washing/rinsing mode, the pulsator 11 is rotated, and when the motor 60 is rotated in the spin-dry mode, the spin-tub 9 is rotated.

The clutch 621 is interposed between the input shaft 622*a* and the second vertical power shaft 622*c* for switching the state of connection between the input shaft 622*a* and the second vertical power shaft 622*c*. Specifically, the clutch 621 switches between a connected state ('connected') in which the input shaft 622*a* and the second vertical power shaft 622*c* are connected so that the motor 60 and the spin tub 9 are connected, and a disconnected state ('disconnected') in which the input shaft 622*a* is decoupled from the second vertical power shaft 622*c* so that the motor 60 and the spin tub 9 are separated.

The clutch 621 is pressed by elastic force of a spring to be in the connected state when the spin tub 9 is rotated at constant speed or acceleration. When the spin tub 9 slows down, the clutch 621 automatically switches the spin tub 9 into the disconnected state (a spring clutch method).

A control system 20 is installed in an upper portion of the main body 2. The control system 20 controls general operation of the washing machine 1. The control system 20 includes hardware components such as a processor, e.g., a central processing unit (CPU), a memory, etc. The memory stores software such as a control program or different types of data. The processor included in the control system may create a control signal to control operation of the washing machine 1 based on the control program and data stored in the memory. The processor and the memory may be implemented in separate chips or in a single chip. Furthermore, the control system 20 may include at least one processor and at least one memory.

Figure 3:
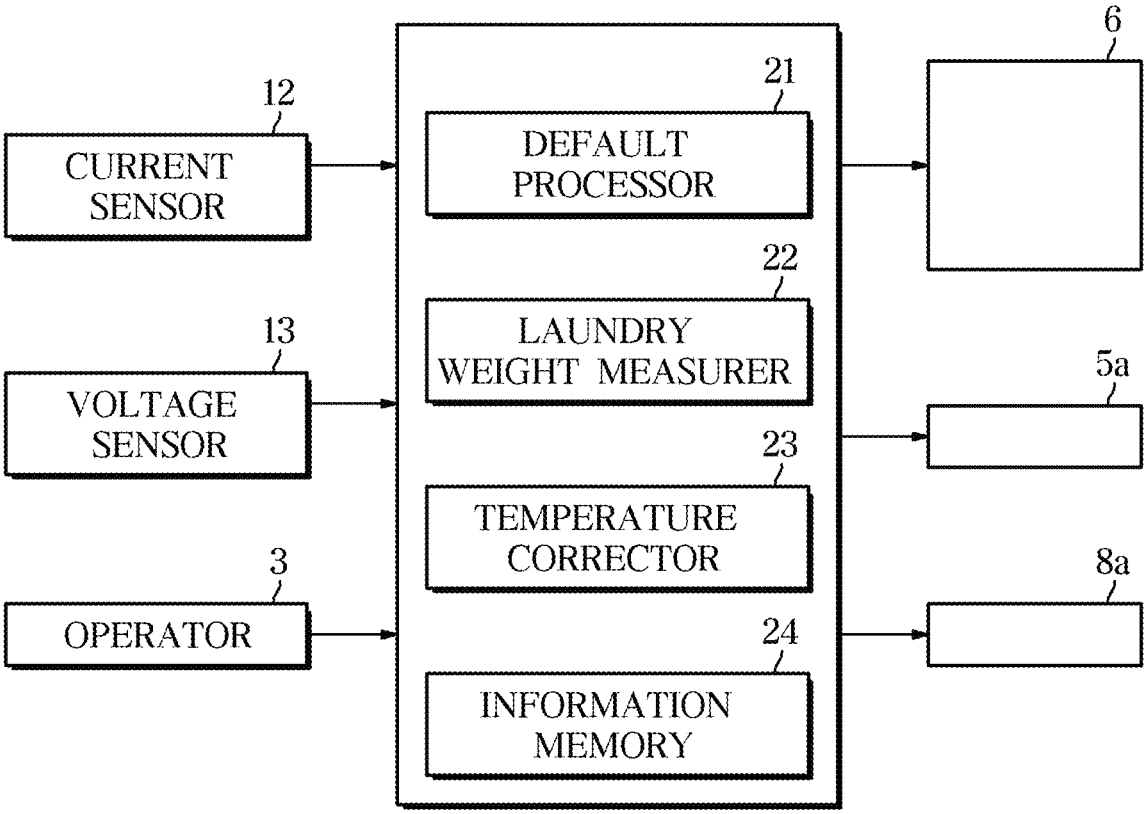
FIG. 3 illustrates a control block diagram of a washing machine, according to an embodiment of the disclosure.

FIG. 3 illustrates key components of the control system 20. The control system 20 is electrically connected to a current sensor 12, a voltage sensor 13, the operator 3, the driving system 6, the water supply valve 8*a*, the drain valve 5*a*, etc. The current sensor 12 measures a current output from the motor 60, and sends the measured value to the control system 20. The voltage sensor 13 measures a voltage output from the motor 60, and sends the measured value to the control system 20. The operator 3 sends information instructing a start of operation, a selection of operation mode, etc., to the control system 20. The control system 20 controls the driving system 6, the water supply valve 8*a*, the drain valve 5*a*, etc., based on the measured values and the instruction information.

The control system 20 includes a default processor 21, a laundry weight measurer 22, a temperature corrector 23, and an information memory 24. The default processor 21 carries out a series of courses such as washing, rinsing, spin-drying, etc., under an instruction. The laundry weight measurer 22 measures and/or identifies the weight of the laundry introduced into the spin tub 9 in the beginning of the washing course (a laundry weight measurement process). The temperature corrector 23 performs a temperature correction process corresponding to a temperature of the motor 60 for the laundry weight measurement process. The information memory 24 stores base information, temperature correction information, etc., which will be described later, and sends the information to the laundry weight measurer 22, the temperature corrector 23, etc. The information memory 24 corresponds to a memory. The processes carried out by the default processor 21, the laundry weight measurer 22, and the temperature corrector 23 may be performed by at least one processor.

Water is automatically supplied in each of washing and rinsing courses. To gain an adequate washing effect and efficiently save water, an adequate amount of water needs to be determined depending on the weight of the laundry. For this, the laundry weight measurer 22 performs the laundry weight measurement process by measuring and/or determining the weight of the laundry introduced into the spin tub 9 in the beginning of the washing course.

As the spin tub 9 slows down, the spin tub 9 is automatically decoupled from the motor 60 and goes into a free state. Because the mechanical load differs during acceleration and deceleration, and it is difficult to measure rotational speed and acceleration during the deceleration, the washing machine 1 may not measure the weight of the laundry using a change in rotational state during deceleration.

In an embodiment, the washing machine 1 may measure the weight of laundry with high accuracy without using the change in rotational state during deceleration. For example, the washing machine 1 turns the spin tub 9 loaded with the laundry (also called a laundry-loaded spin tub 9) by applying torque to the spin tub 9, and measures the weight of the laundry based on acceleration and rotational speed during constant-speed rotation of the laundry-loaded spin tub 9.

When the laundry-loaded spin tub 9 is rotated under a certain torque by driving of the motor 60, the laundry-loaded spin tub 9 is engaged with the output of the motor 60 and accelerated, and then rotated at a constant speed corresponding to the torque. In this case, the acceleration and rotational speed of the laundry-loaded spin tub 9 are affected by a mechanical loss, such as a friction occurring in the driving system 6.

Hence, when the weight of the laundry is measured based on the acceleration and rotational speed without reflecting the mechanical loss, the measurement may turn out to be inaccurate. The acceleration and the rotational speed, which are affected by the mechanical loss, have a predefined linear relationship associated with the size of a load applied to the spin tub 9.

Figure 4:
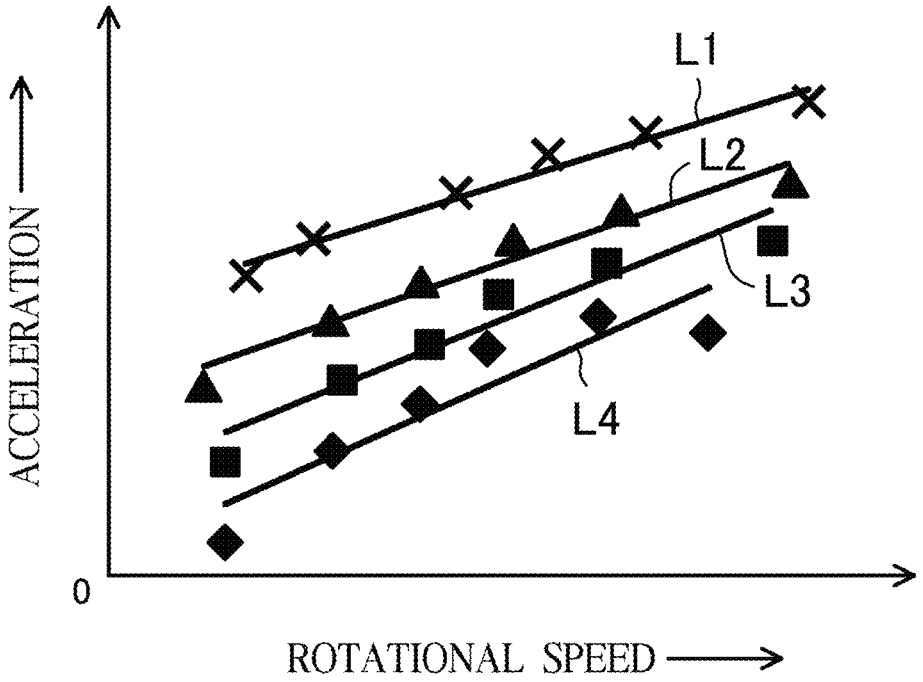
FIG. 4 illustrates a graph representing linear relationships that exist between acceleration and rotational speed.

FIG. 4 illustrates an example of a linear relationship that exists between acceleration and rotational speed. The vertical axis represents acceleration and the horizontal axis represents rotational speed. Straight lines L1 to L4 represent linear relationships between acceleration and rotational speed for different sizes of load applied to the spin tub 9. The load of L1 is 4 kg, L2 is 2 kg, L3 is 1 kg, and L4 is 0 kg.

The acceleration and the rotational speed, which are affected by the mechanical loss, have a linear relationship defined as a (acceleration)=k (coefficient)×ω(rotational speed)+Z, depending on the size of a load applied to the spin tub 9.

As shown in FIG. 4, the load applied to the spin tub 9 and Z have a proportional relationship. That is, Z(α-k·ω) is proportional to the load applied to the spin tub 9. Accordingly, based on this relationship, the load applied to the spin tub 9 may be calculated.

For example, each load Z shown in FIG. 4 and Z calculated from the measurement are compared in value. Accordingly, it is determined whether the load applied to the spin tub 9 is in a range of 0 to 1 kg, 1 kg to 2 kg, 2 kg to 4 kg, or 4 kg or more, and based on the determination, the weight of the laundry is identified.

The coefficient k varies depending on the driving voltage or frequency. The information about the linear relationship is experimentally obtained, and stored in the information memory 24 as base information.

Detection of the acceleration is easily affected by temperature. Especially, as for an inductive motor, the acceleration and rotational speed vary by the temperature at the time of rotation, which might influence the measurement accuracy. In an embodiment, the washing machine 1 may even make a temperature correction in the laundry weight measurement process.

Figure 5:
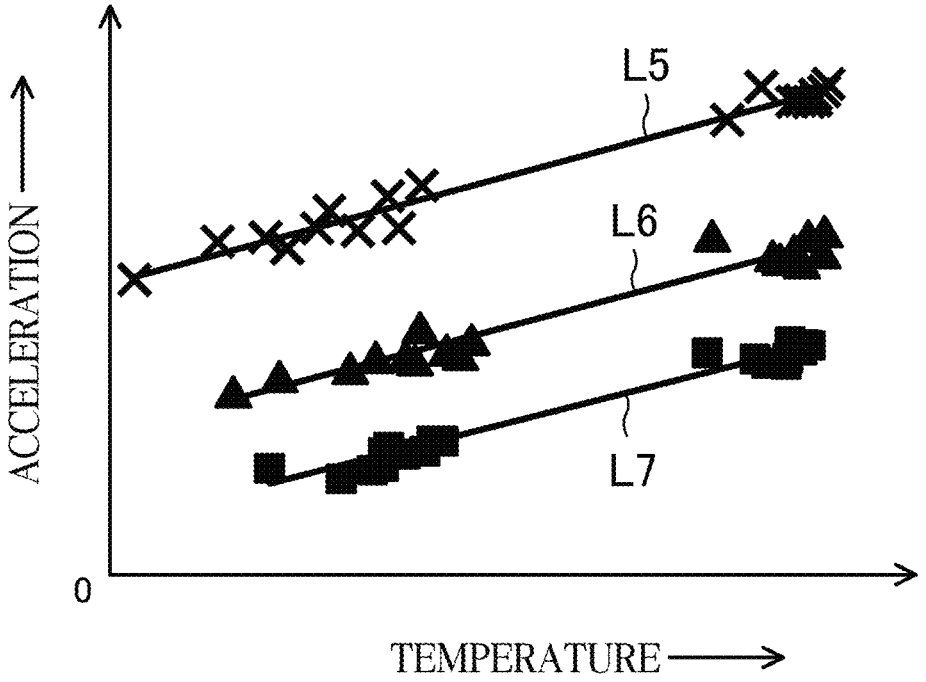
FIG. 5 illustrates a graph representing relationships between acceleration and motor temperature.

FIG. 5 illustrates relationships between acceleration and motor temperature. The acceleration and the motor temperature have also a linear relationship associated with the size of the load applied to the spin tub 9. Straight lines L5 to L7 represent linear relationships between acceleration and motor temperature for different loads applied to the spin tub 9. The load of L5 is 4 kg, L6 is 2 kg, and L7 is 1 kg. Although not shown, a similar linear relationship exists between the rotational speed and the temperature of the motor 60.

The information about the linear relationship is experimentally obtained, and stored in the information memory 24 as temperature correction information. A temperature corrector 23 corrects the acceleration and rotational speed (second rotational speed) of the laundry-loaded spin tub 9 depending on the temperature of the motor 60 based on the temperature correction information. Accordingly, an accurate laundry weight measurement process is possible.

Motor temperature may be measured by e.g., a temperature sensor installed at the motor 60. In this case, however, the need for newly setting up the temperature sensor may cause increasing product cost or increasing number of manufacturing processes. In an embodiment of the disclosure, the washing machine 1 measures the temperature of the motor 60 indirectly without using the temperature sensor.

For example, the temperature of the motor 60 is measured by using a linear relationship between temperature and resistance of the coil 60*a*. Specifically, the information memory 24 stores information (resistance information) about a linear relationship between temperature and resistance of the motor 60 in advance. The resistance information may be experimentally obtained. In the laundry weight measurement process, the control system 20 controls the inverter 61 to perform a temperature measurement process that applies a predefined DC voltage to the coil 60*a*.

Resistance R of the coil 60*a*, a DC current I flowing in the coil 60*a*, and a DC voltage V applied across the coil 60*a* have such a relationship as R=V/I. When performing the temperature measurement process, the control system 20 identifies the resistance of the coil 60*a* by substituting the measurements obtained from the current sensor 12 and the voltage sensor 13 in the equation. The control system 20 identifies a motor temperature by comparing the identified resistance with resistance information.

Acceleration and rotational speed of the motor 60 may be measured by an instrumentation device, such as e.g., a resolver or a rotary encoder installed at the motor 60. In this case, however, the need for newly setting up the instrument device may cause increasing product cost or increasing number of manufacturing processes. Hence, in an embodiment of the disclosure, the washing machine 1 indirectly measures the acceleration and rotational speed of the motor 60.

For example, the control system 20 obtains current values Id and Iq by performing αβ conversion and dq conversion over the current values Iu of phase U, Iv of phases V, and Iw of phases W, received from the current sensor 12 while the motor 60 is rotated. The rotation frequency ωs due to slip is obtained by calculating Iq/Id. The rotational speed ω of the spin tub 9 is obtained by subtracting the rotation frequency ωs due to the slip from the frequency ωi of a voltage for driving the motor 60 (ωi-ωs).

As such, the control system 20 obtains the acceleration and rotational speed of the motor 60 by performing arithmetic operations based on the values received from the current sensor 12 without the need for an instrumentation device.

Figure 6:
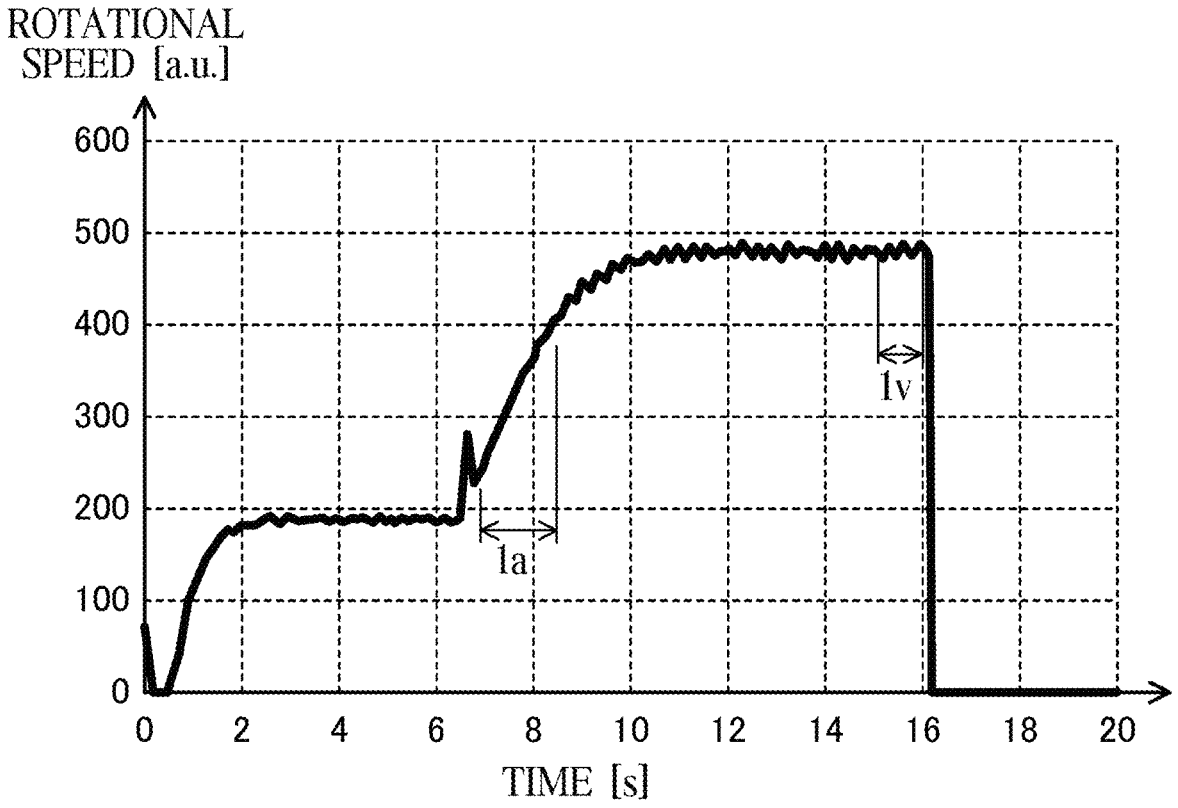
FIG. 6 illustrates a graph representing changes in rotational speed of a spin tub, which are used in measuring the weight of laundry.

FIG. 6 illustrates changes in rotational speed of the spin tub 9 over time, which are used in measuring the weight of laundry.

The control system 20 (the laundry weight measurer 22 in particular) controls the inverter 61 from a state in which the laundry-loaded spin tub 9 is stopped (torque control). Because a certain magnitude of torque (first torque) is applied to the laundry-loaded spin tub 9, the laundry-loaded spin tub 9 is gradually accelerated and stabilized at a highest rpm that may be reached by the first torque, and rotated at a constant speed of the rpm (the first rpm) (a first constant speed rotation process). The first rpm refers to a first rotational speed.

The control system 20 applies an AC current with a first voltage and first frequency to the motor 60. For example, an AC current with 120 V and a frequency that aims at 250 rpm is applied to the motor 60. The laundry-loaded spin tub 9 is accelerated accordingly, and then rotated at a constant speed of the first rotational speed, which is about 200 rpm.

The control system 20 applies second torque to the spin tub 9, the second torque being greater than the first torque, in order for the spin tub 9 rotating at the first rotational speed to be rotated at the second rotational speed that is higher than the first rotational speed (a second constant speed rotation process).

In FIG. 6, in about 6 seconds for which the first constant speed rotation becomes stabilized, the frequency of the AC current is changed to a second frequency that aims at 500 rpm, and the second torque is applied to the laundry-loaded spin tub 9. For second constant speed rotation, the second voltage applied to the motor 60 may be equal to the first voltage. Accordingly, the spin tub 9 is accelerated and then rotated at a constant speed of the second rotational speed, which is about 490 rpm.

The control system 20 obtains the acceleration at the changing moment from the first rotational speed to the second rotational speed, and the second rotational speed for the second constant speed rotation.

The acceleration may be obtained by using an acceleration section 1*a* (about 2 seconds) having high linearity. For example, the acceleration may be obtained by measuring the speeds at the beginning and at the end of the acceleration period 1*a* and dividing them by the elapsed time. A plurality of speeds in the acceleration period 1*a* may be measured, and the acceleration may be obtained by a first approximation.

Furthermore, the second rotational speed may be obtained when the spin tub 9 is somewhat stabilized. In FIG. 6, the second rotational speed is measured in a stabilized section 1*v* (about 1 second) in 10 minutes after the second constant speed rotation process begins. The second rotational speed may be obtained by performing measurement several times and averaging the measurements.

As the motor 60 is an asynchronous motor, the control system 20 drives the motor 60 at a predefined voltage and frequency to apply certain torque to the laundry-loaded spin tub 9. The second voltage for the second constant speed rotation process may be higher than the first voltage for the first constant speed rotation process. This attains higher acceleration, and a time required for measurement may be reduced. In this case, the second frequency for the second constant speed rotation process may be equal to the first frequency for the first constant speed rotation process.

As such, the control system 20 obtains the acceleration and rotational speed of the motor 60. Subsequently, the control system 20 may make temperature correction and mechanical loss correction for the obtained acceleration and rotational speed, and measure the weight of the laundry.

Figure 7:
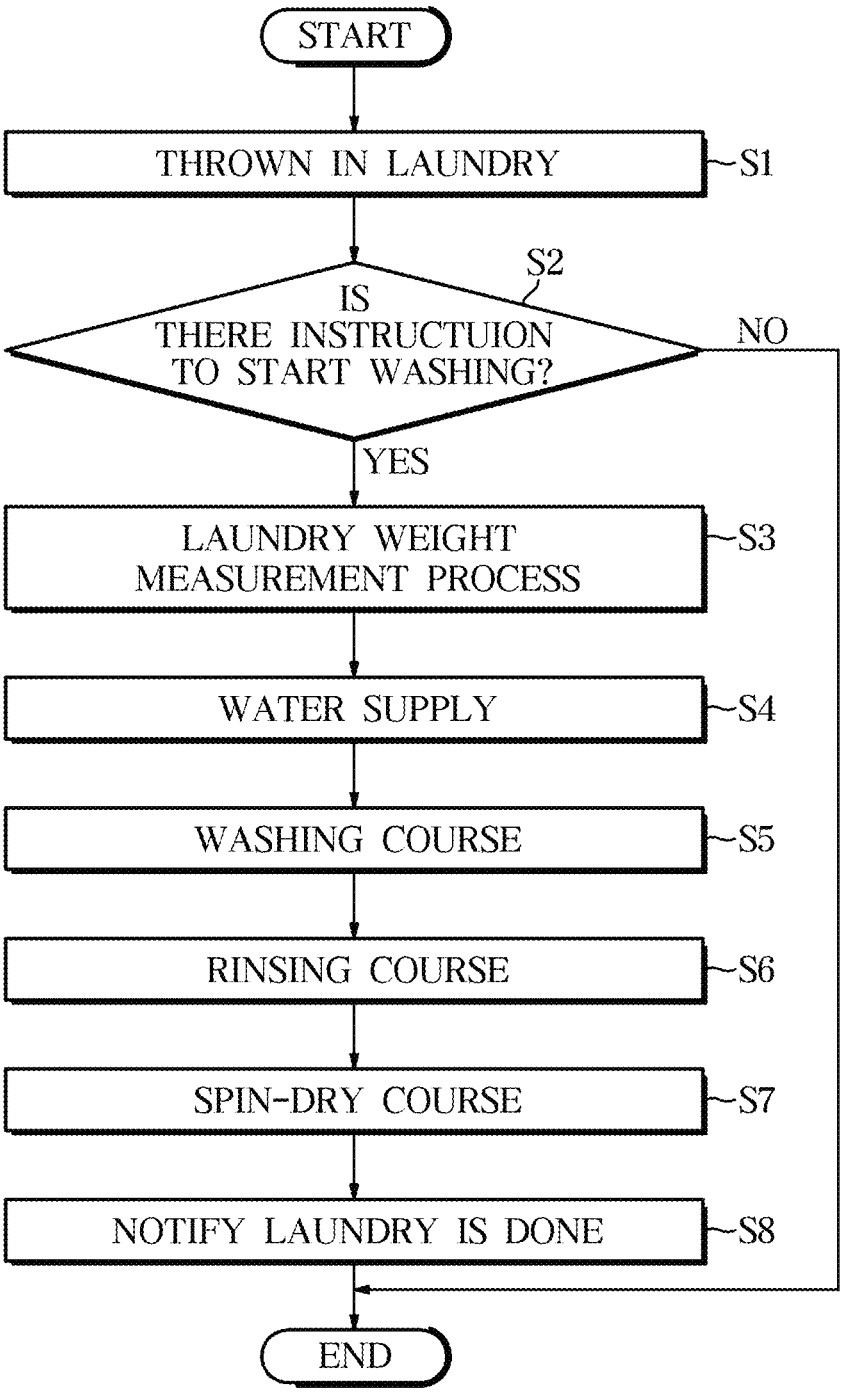
FIG. 7 is a flowchart illustrating a control method of a washing machine, according to an embodiment of the disclosure.
Figure 8A:
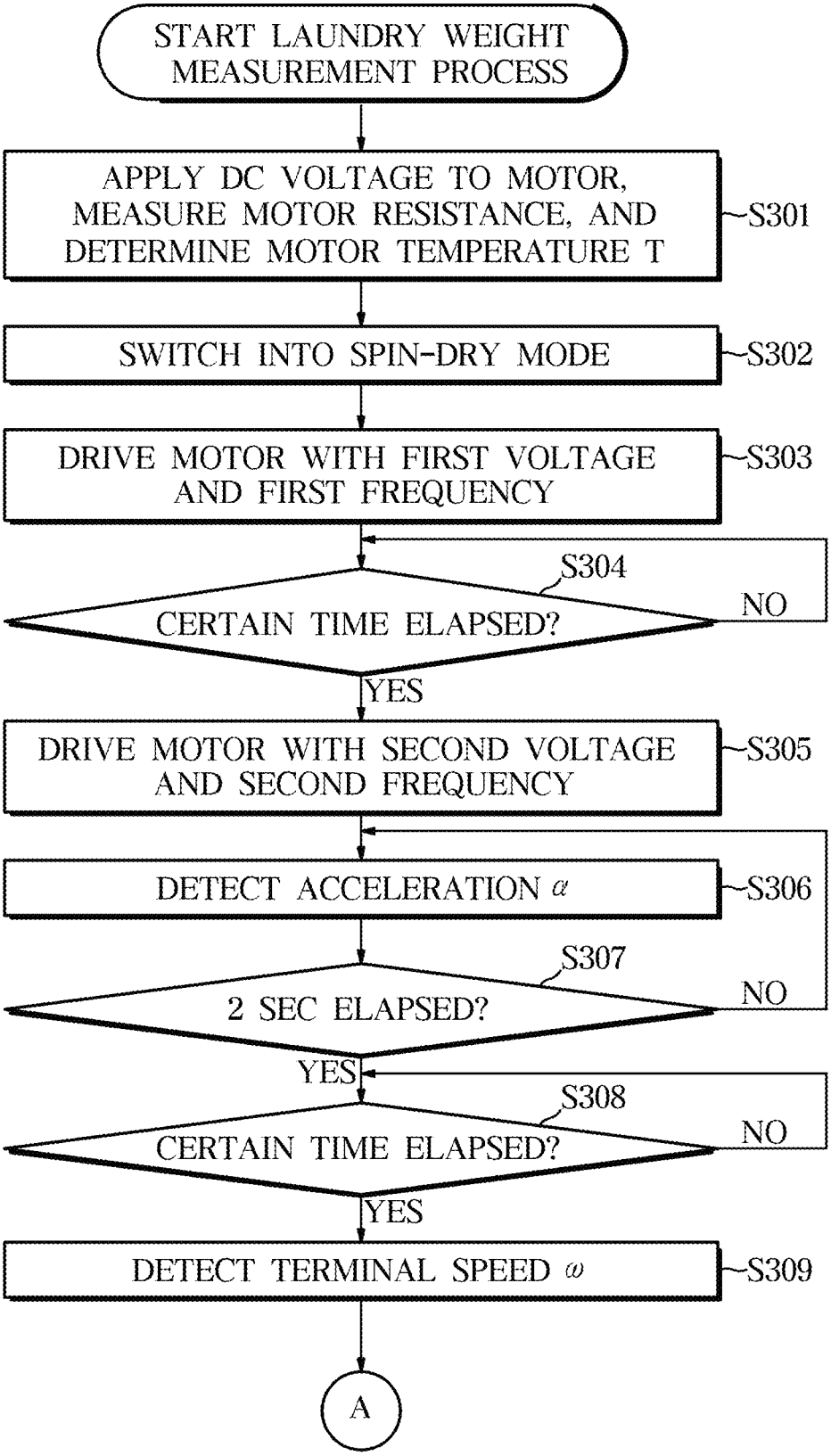
FIG. 8A and FIG. 8B are flowcharts illustrating a method of determining the weight of laundry, according to an embodiment of the disclosure.
Figure 8B:
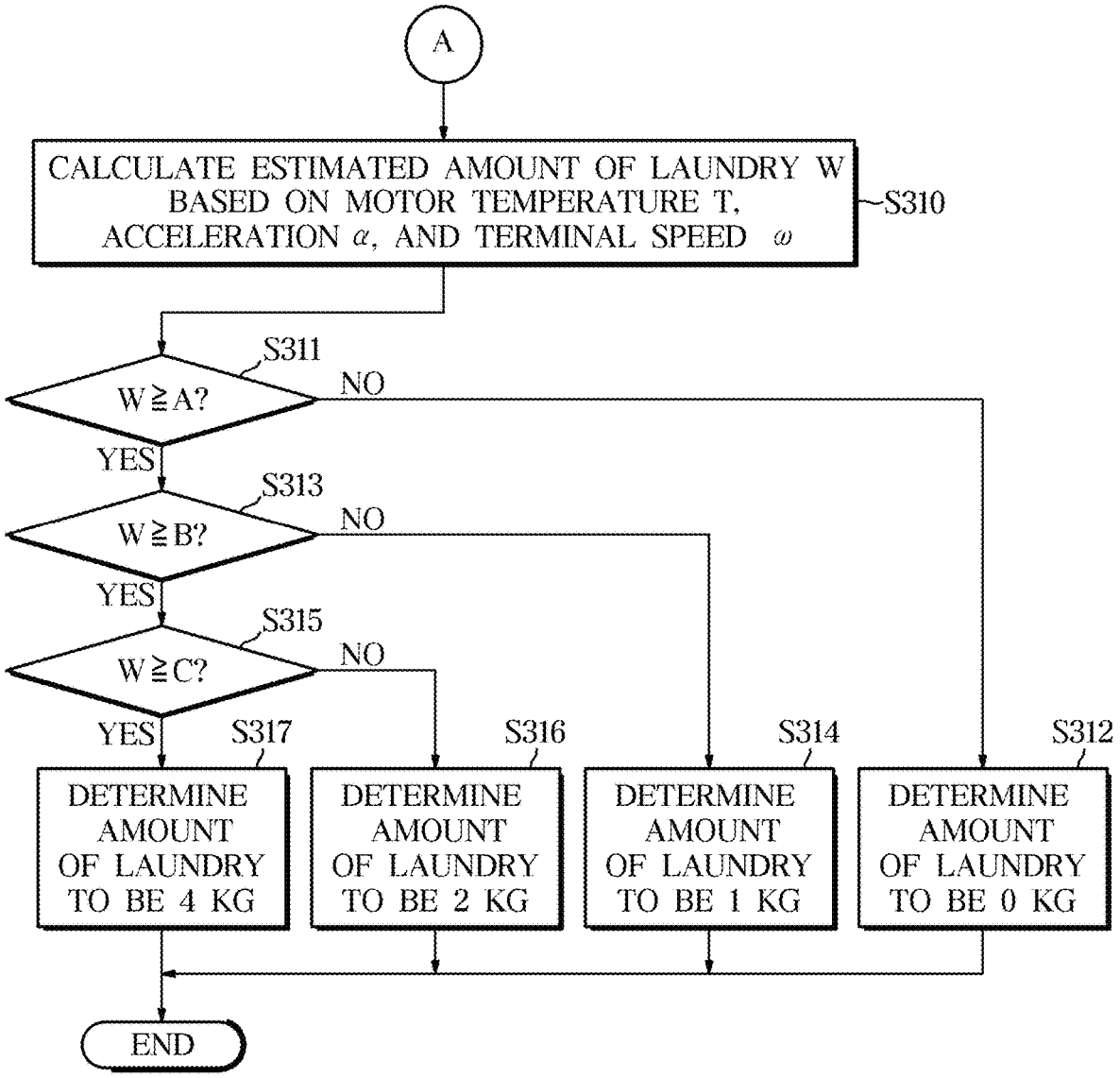

FIG. 7 illustrates a flowchart of a control method of a washing machine, according to an embodiment of the disclosure, and FIG. 8A and FIG. 8B illustrate flowcharts of a method of determining the weight of the laundry, according to an embodiment of the disclosure.

Referring to FIG. 7, laundry is introduced into the spin tub 9 first when a washing course is performed, in S1. A detergent is put into the washing machine 1 along with the laundry. An instruction to start washing is input through the operator 3, in S2. The control system 20 (the default processor 21 in particular) automatically carries out a series of washing, rinsing, and spin-drying courses under the instruction.

In the beginning of the washing course, the control system 20 (the laundry weight measurer 22 in particular) performs the laundry weight measurement process to determine an appropriate amount of water supply, in S3. FIG. 8A and FIG. 8B show details of the method.

The control system 20 (the temperature corrector 23 in particular) performs a temperature measurement process, in S301. Specifically, as described above, the control system 20 controls the inverter 61 to apply a predefined DC voltage to the coil 60*a* and measures actual resistance of the coil 60*a*. The control system 20 identifies the temperature of the motor 60 by comparing the measured actual resistance with resistance information.

Subsequently, the control system 20 controls the power transmission system 62 to switch the conversion mechanism part 622 into a spin-drying mode, in S302. As the motor 60 is driven accordingly, the spin tub 9 is rotated as well.

As shown in FIG. 6, the control system 20 controls the inverter 61 to apply the first torque to the spin tub 9, thereby driving the motor 60 with the first voltage and first frequency, in S303. When the rotational speed of the spin tub 9 is stabilized at the first rotational speed in a certain time in S304, the control system 20 controls the inverter 61 to apply the second torque to the spin tub 9, thereby driving the motor 60 with the second voltage and second frequency in S305. The second voltage may be equal to the first voltage, and the second frequency may be higher than the first frequency. Alternatively, the second voltage may be higher than the first voltage, and the second frequency may be equal to the first frequency. As such, the voltage and frequency applied to the motor 60 may be separately controlled.

The control system 20 detects acceleration using an acceleration section, in S306 and S307. When the spin tub 9 is stabilized at a second rotational speed in a certain time, in S308, the control system 20 detects the second rotational speed (terminal velocity), in S309.

The control system 20 estimates an amount of laundry based on the temperature, acceleration, and rotational speed of the motor 60, in S310.

The control system 20 compares the estimated amount of laundry W with a weight distinction value stored in the information memory 24 (herein, there are three weight distinction values A, B, and C based on the relationship of FIG. 4. C≥B≥A).

When the estimated amount of laundry W is less than weight distinction value A in S311, the control system 20 identifies that the amount of laundry is 0 kg in S312.

When the estimated amount of laundry W is equal to or greater than the weight distinction value A in S311, the control system 20 compares the estimated amount of laundry W with the weight distinction value B in S313. When the estimated amount of laundry W is less than the weight distinction value B in S313, the control system 20 identifies that the amount of laundry is 1 kg in S314.

When the estimated amount of laundry W is equal to or greater than the weight distinction value B in S313, the control system 20 compares the estimated amount of laundry W with the weight distinction value C in S315. When the estimated amount of laundry W is less than the weight distinction value C in S315, the control system 20 identifies that the amount of laundry is 2 kg in S316, and when the estimated amount of laundry W is equal to or greater than the weight distinction value C in S315, the control system 20 identifies that the amount of laundry is 4 kg in S317.

Once the control system 20 identifies the amount of laundry, water supply begins in S4, as shown in FIG. 7.

The information memory 24 stores water supply information that enables an amount of water supply corresponding to the amount of laundry to be set. The control system 20 selects an appropriate amount of water supply by comparing the identified amount of laundry with the water supply information. The control system 20 controls the water supply valve 8*a* to supply as much water as the selected amount of water supply to the fixed tub 4.

When the water supply is done, the control system 20 starts the washing course, in S5. In the washing course, the conversion mechanism part 622 switches the washing machine 1 from the spin-drying mode to the washing/rinsing mode. The pulsator 11 is driven to be rotated at low speed for a predefined time to agitate the laundry. After this, the drain valve 5*a* is controlled to release the water from the fixed tub 4 and the washing course is ended.

When the washing course is ended, the control system 20 starts the rinsing course, in S6. Even in the rinsing course, as in the washing course, water supply, agitation, and drain are performed. The rinsing course may be performed several times.

When the rinsing course is ended, the control system 20 starts the spin-drying course, in S7. In the spin-drying course, the conversion mechanism part 622 switches the washing machine 1 from the washing/rinsing mode to the spin-drying mode. The spin-tub 9 is driven to be rotated at high speed for a predefined time to dewater the laundry. The water collected into the fixed tub 4 due to the spin-dry is discharged through the drain system 5.

When the spin-dry course is ended, the control system 20 notifies the user that the laundry is done e.g., through a buzzer.

In an embodiment, it is assumed that the motor 60 is an asynchronous motor. However the disclosure is also applicable to a synchronous motor. In an embodiment, it is assumed that the motor 60 is a synchronous motor.

Except that the motor 60 is a synchronous motor, the structure of the washing machine 1 is the same as in a previous embodiment. Accordingly, description of the same parts will be omitted or simplified, and different parts will be described.

The motor 60 is e.g., a permanent magnet-type motor (synchronous motor). The rotor 60*c* includes a plurality of permanent magnets that constitute a plurality of magnetic poles. As for the motor 60, when an AC current of a different phase flows in each coil 60*a*, the rotor 60*c* is rotated at a (synchronous) speed in sync with the AC current (without occurrence of slip).

Accordingly, the control system 20 controls the inverter 61 to apply particular torque to the spin tub 9, thereby regulating the current to drive the motor 60. In other words, the control system 20 may drive the motor 60 with a predefined current.

Figure 9A:
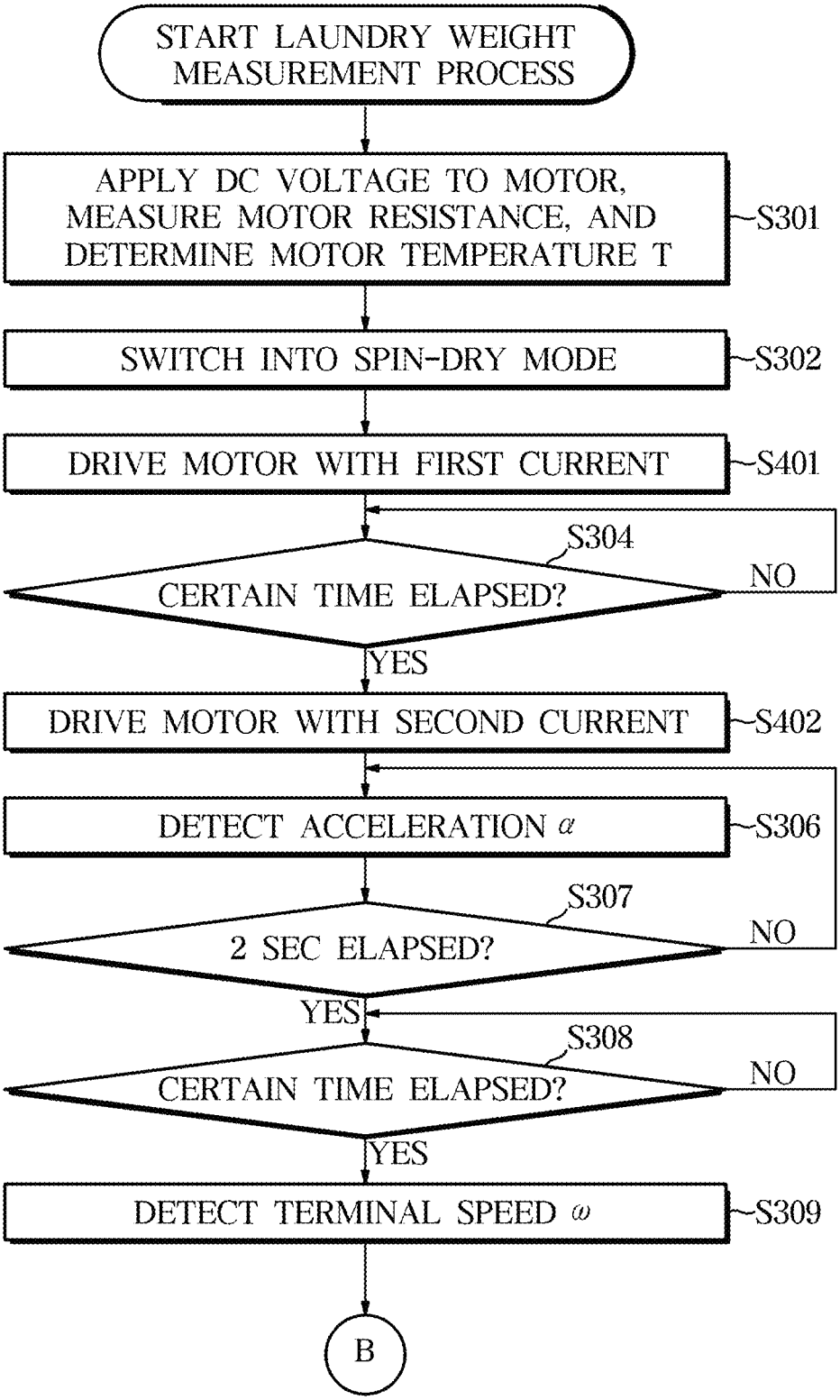
FIG. 9A and FIG. 9B are flowcharts illustrating a method of determining the weight of laundry, according to an embodiment of the disclosure.
Figure 9B:
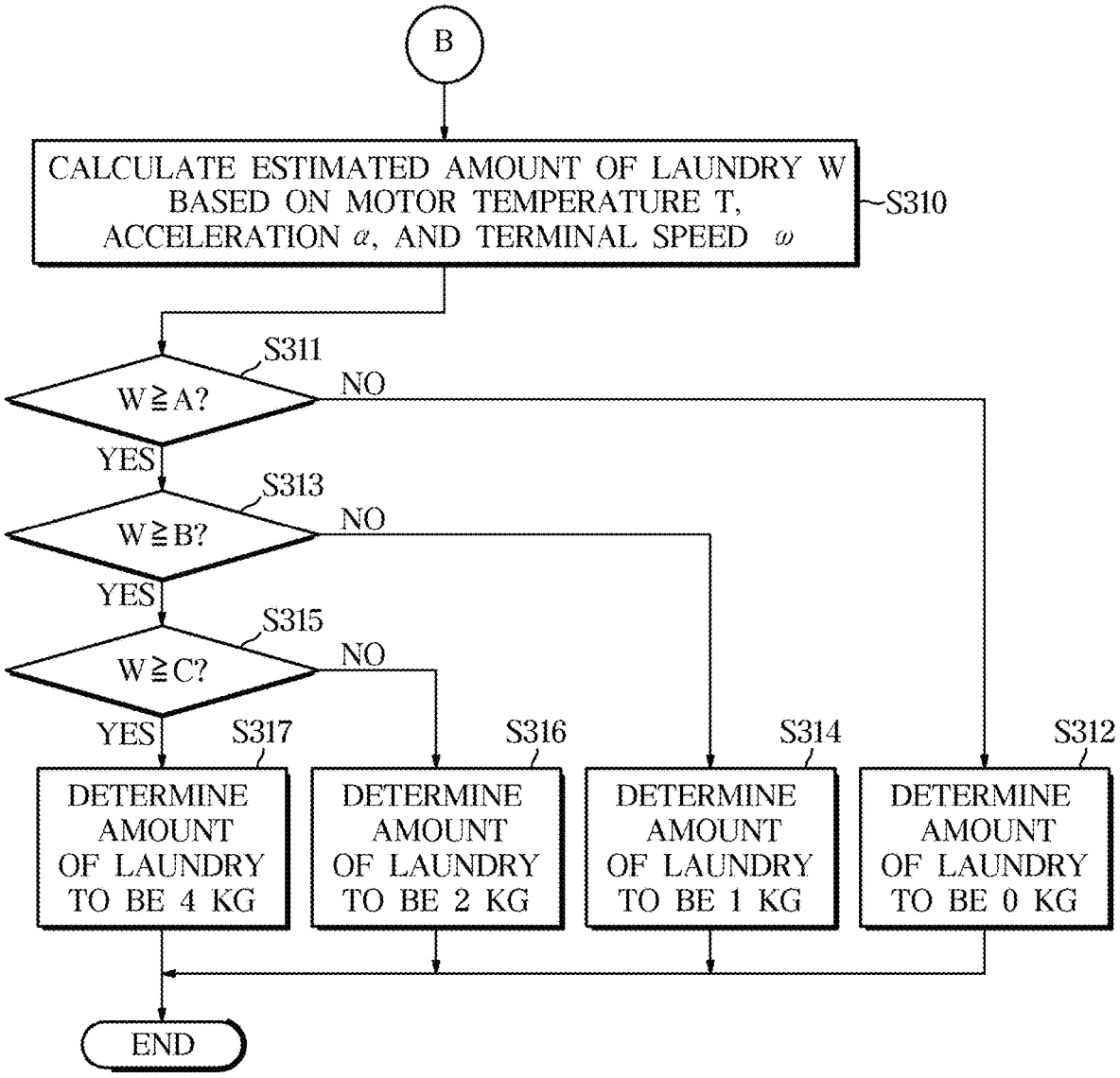

FIG. 9A and FIG. 9B are flowcharts illustrating a method of determining the weight of laundry, according to another embodiment of the disclosure. The embodiment of FIG. 9A and FIG. 9B overlap some of the previous embodiment of FIG. 8A and FIG. 8B. Accordingly, description of the overlapping parts will not be repeated or will be simplified by using the same reference numerals.

The control system 20 performs the temperature measurement process in S301, and then switches the conversion mechanism part 622 into a spin-drying mode in S302.

The control system 20 controls the inverter 61 to apply the first torque to the spin tub 9, thereby driving the motor 60 with the first current, in S401. When the rotational speed of the spin tub 9 is stabilized at the first rotational speed in a certain time in S304, the control system 20 controls the inverter 61 to apply the second torque to the spin tub 9, thereby driving the motor 60 with the second current in S402.

Subsequent steps (S306 to S317) are the same as in FIG. 8A and FIG. 8B. The disclosure is applicable both to the asynchronous motor and the synchronous motor by replacing the target subject to be controlled to apply certain torque to the spin tub 9.

The disclosure is not limited to the aforementioned embodiments but includes other various embodiments. For example, the washing machine is not limited to the top-load washing machine. The washing machine may also be a drum washing machine whose rotational axis is horizontal or inclined.

Types of the washing machine 1 are not limited to the type in which the motor drives the spin tub indirectly like the washing machine 1 that employs the aforementioned spring clutch method. The disclosure may also be applied to a direct-drive type washing machine in which the motor drives the spin tub directly.

Furthermore, the disclosure is suitable to a simple belt-driven washing machine rather than the spring-clutch type washing machine. Specifically, in a washing machine that transmits driving power of the motor to the spin tub through a variable belt, the motor rpm and the spin tub rpm may not correspond to each other due to e.g., slip of the variable belt. The technology of the disclosure is thus effective even for the belt-driven washing machine.

The laundry weight measurement process may be performed several times, and the weight of the laundry may be identified based on the plurality of measurement results. This enables more accurate determination of the weight of the laundry. In this case, the torque applied to the spin tub may vary. Furthermore, the rotational speed may use the first rpm instead of the second rpm.

In the case of performing the laundry weight measurement process several times, the same procedure may be repeated, or different procedures in which acceleration and rotational speed may be measured by gradually increasing the rpm i.e., sequentially performing the first constant speed rotation process, the second constant speed rotation process, the third constant speed rotation process, etc.

The motor temperature may be measured by a temperature sensor. Acceleration or rotational speed of the spin tub may be actually measured by a sensor. The motor may be a two-phase motor or a one-phase motor as well as the three-phase motor.

According to embodiments of the disclosure, in any type of washing machine, an amount of the laundry introduced into the washing machine may be measured for a short time with high accuracy. As a result, more effective water-saving may be expected.

Although the present disclosure has been described with various embodiments, various changes and modifications may be suggested to one skilled in the art. It is intended that the present disclosure encompass such changes and modifications as fall within the scope of the appended claims.

What is claimed is:

1. A washing machine comprising:

a spin tub configured to be rotatable and into which laundry is introduced;

a driving system including a motor and configured to rotate the spin tub; and at least one processor configured to:

control the driving system to apply a first torque to rotate the spin tub at a first rotational speed, after rotation speed of the spin tub is stabilized to the first rotational speed, control the driving system to apply a second torque greater than the first torque during an acceleration period to rotate the spin tub at a second rotational speed higher than the first rotational speed, identify acceleration of the spin tub while rotational speed of the spin tub increases from the first rotational speed to the second rotational speed, after rotation speed of the spin tub is stabilized to the second rotational speed, identify a value of the second rotational speed, and identify a weight of the laundry based on the second rotational speed and the acceleration.

2. The washing machine of claim 1, further comprising:

at least one memory, wherein the at least one memory stores base information including linear relationship information between the acceleration and the second rotational speed associated with a size of a load applied to the spin tub, and wherein the at least one processor is configured to identify the weight of the laundry based on the acceleration, the second rotational speed, and the base information.

3. The washing machine of claim 1, wherein:
the motor is an asynchronous motor, and
the at least one processor is configured to:
control the driving system to drive the motor with a first voltage and a first frequency such that the spin tub is rotated at the first rotational speed, and
control the driving system to drive the motor with a second voltage and a second frequency such that the spin tub is rotated at the second rotational speed.

4. The washing machine of claim 3, wherein:
the driving system comprises an inverter for controlling the motor, and
the at least one processor is configured to obtain the acceleration and the second rotational speed based on a current output from the inverter to the motor.

5. The washing machine of claim 1, wherein:
the motor is a synchronous motor, and
the at least one processor is configured to control the driving system to drive the motor with a first current such that the spin tub is rotated at the first rotational speed, and control the driving system to drive the motor with a second current such that the spin tub is rotated at the second rotational speed.

6. The washing machine of claim 1, further comprising: at least one memory,
wherein the memory stores temperature correction information including linear relationship information between each of the acceleration and the second rotational speed, and a temperature of the motor, and
wherein the at least one processor is configured to correct the acceleration and the second rotational speed based on the temperature correction information.

7. The washing machine of claim 6, wherein the at least one processor is configured to identify the temperature of the motor based on a resistance of a coil of the motor and resistance information stored in the memory.

8. The washing machine of claim 7, wherein the at least one processor is configured to control the driving system to apply a predefined direct current (DC) voltage to the coil, and measure the resistance of the coil.

9. The washing machine of claim 1, wherein the at least one processor is configured to:
identify a measurement of the weight of the laundry at multiple times, and
identify the weight of the laundry based on multiple measurement results.

10. The washing machine of claim 9, wherein the at least one processor is configured to control the driving system to rotate the spin tub at a different speed for each of the multiple times.

11. The washing machine of claim 1, wherein the driving system comprises a clutch for switching between a connected state in which the motor and the spin tub are connected and a disconnected state in which the motor and the spin tub are disconnected, and
wherein the clutch switches the spin tub from the connected state to the disconnected state when the spin tub is decelerated.

12. The washing machine of claim 1, wherein the driving system comprises a variable belt interposed between the motor and the spin tub for transmitting a driving power of the motor to the spin tub.

* * * * *